US007267571B1

(12) United States Patent
Twigg et al.

(10) Patent No.: US 7,267,571 B1
(45) Date of Patent: Sep. 11, 2007

(54) DOUBLE WALL CONNECTOR

(75) Inventors: Richard D. Twigg, Leander, TX (US); Janette M. Moré, Austin, TX (US); Thomas E. Umlauf, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/556,293

(22) Filed: Nov. 3, 2006

(51) Int. Cl.
*H01R 4/24* (2006.01)

(52) U.S. Cl. ..... 439/402

(58) Field of Classification Search ..... 439/391–407
See application file for complete search history.

(56) References Cited

U.S. PATENT DOCUMENTS 3,656,088 A 4/1972 Seim
4,444,447 A 4/1984 Markwardt
4,496,206 A 1/1985 Markwardt et al.
4,891,018 A 1/1990 Afflerbaugh et al.
4,944,689 A * 7/1990 Carr ..... 439/417
4,964,811 A * 10/1990 Hayes et al. ..... 439/398
5,067,910 A 11/1991 Knox et al.
5,120,246 A 6/1992 Knox
5,562,478 A * 10/1996 Yamamoto ..... 439/402
5,626,489 A 5/1997 Marshall et al.
6,837,737 B2 * 1/2005 Baier et al. ..... 439/402

* cited by examiner

*Primary Examiner*—James R. Harvey
(74) *Attorney, Agent, or Firm*—David J. Shenk

(57) ABSTRACT

A connector includes a base member and a cap designed to be fitted onto each other. The base member or the cap may have a double-wall configuration to improve stability, strength, and durability of the connector unit as a whole. The base member includes a plurality of ribs forming wire-receiving channels and having at least one groove therebetween. The cap includes a conductive connecting plate configured to fit in the groove of the ribs of the base member. The connecting plate itself includes grooves configured to align with the channels of the ribs of the base member to thereby cut and remove insulation of at least one cable housed in the channels.

18 Claims, 6 Drawing Sheets

DOUBLE WALL CONNECTOR

BACKGROUND

Solderless connectors to effectuate an insulation displacing wire connection have been employed as a conventional way to connect electrical wires in the electrical industry. Such wire connectors often include a base member with channels to receive one or more insulative wires and a cap supporting a suitable contact element.

One common problem with conventional connectors is that the contact element sometimes wobbles or fails to remain completely stable upon application of large forces necessary to cut through some types of cable insulation and connect the conductors. This instability is compounded by virtue of the fact that there is no vertical stabilizing effect upon the cap as the contact element attempts to pierce through the cable insulation and connect the conductors, thereby rendering the cap itself somewhat unstable as it may wobble or move horizontally or in directions other than the desirable vertical direction toward the base member. The relative instability of the cap and the contact element increases under application of increasing force. Furthermore, the risk of full or partial failure of the cap and/or the contact member also increases as the application of force increases. Such a scenario results in frustration or unease of the operator as he or she struggles in many cases to cleanly and smoothly force the cap in an acceptable vertical manner onto the base member and thereby force the contact member in an acceptable vertical manner through the cable insulation.

An improvement is desired in the art so as to enhance the relative strength, stability, and durability of the connector unit as a whole.

SUMMARY

Various alternative embodiments of the invention can include, for example, a base member having a number of side-by-side elongate ribs forming wire-receiving channels. The wire-receiving channels can support the plurality of wires. At least one groove extends between each of the ribs and generally perpendicular to the channels. The base member includes a wall member having an inner and outer surface housing the ribs. A cavity is defined within the base member including an opening between the wall member and the ribs.

Embodiments of the invention can also include, for example, a cap that can fit onto the base member. The cap has an end wall and a pair of side walls including inside and outside walls both having inner and outer surfaces. The outer surface of the inside wall of the cap can interface with the inner surface of the wall member of the base member. The inner surface of the outside wall of the cap can interface with the outer surface of the wall member of the base member. The inside wall of the cap can penetrates a portion of the cavity of the base member and the outside wall of the cap can surround a portion of the wall member of the base member when the wall member of the base member is interposed between the side walls of the cap. Such cooperative relationship is achieved responsive to sufficient force applied to move the cap and the base member into engagement with each other.

Embodiments of the invention can also include, for example, a conductive connecting member including a plate affixed to the cap. The plate of the cap can fit within the groove in the base member. The connecting member is supported by the cap at an interior surface of the end wall of the cap and is housed within the side walls. The plate itself has at least one slot. Each slot of the plate can be aligned with each of the channels of the ribs. In this manner, the connecting member is can afford effective conductive contact with the number of wires disposed in the channels of the ribs.

This summary example is not intended to be exhaustive, and other various alternative embodiments are possible as described in more detail hereinafter.

DETAILED DESCRIPTION

Figure 15:
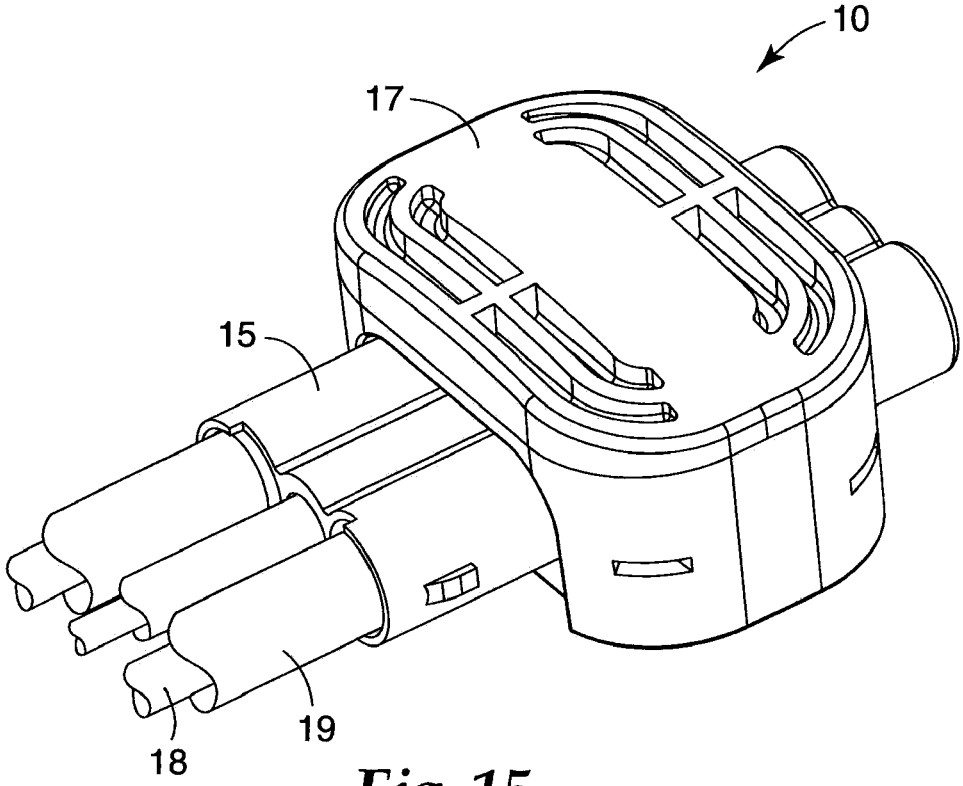
FIG. 15 is an isometric view of the base member and cap collectively as a closed connecting unit and featuring a cable employed therein.

The connector unit 10 as a whole comprises an insulating base member 15 and an insulating cap 17 which fit onto each other to form an electrical connection between or among several conductors 18 of several wires 19 when the wires 19 are inserted into the connector 10 between the base member 15 and the cap 17, as shown in FIG. 15. The wires can include, for example, sizes ranging between 12-18 gauge. The conductors can be stranded or solid or both. An exemplary connector unit 10 in its final form is illustrated in FIG. 15.

Embodiments of the invention can include, for example, a single-wall base member 15 fit onto a double-wall cap 17. One illustrative embodiment of the base member 15 and cap 17 is shown in FIGS. 1-6. Embodiments of the base member 15 can include, for example, a number of side-by-side elongate ribs 20 forming wire-receiving channels 24 to support or carry a number of corresponding wires or wire-ends to be connected. The ribs 20 can begin at an end of a throat portion of the base member 15 and extend into a body portion where they provide wire supporting channels 24. The wire-receiving channels 24 formed by the ribs 20 can be tubular, cylindrical, or circular spaces to allow a tubular wire to be extended and supported therethrough. The wire-receiving channels 24 of the ribs 20 can have an inner diameter that substantially interfaces with a portion of the outer diameter of a wire to be connected in the connector 10. The wire-receiving channels 24 can be formed of the ribs 20 on the inside portion of the base member 15 and/or the wire-receiving channels 24 can also, for example, continue toward the outside portion of the base member 15 where the insulated cable enters the connector 10. The number of ribs 20 can be spaced apart such that at least one groove 26 extends between each of the ribs and generally perpendicular to the channels 24 to receive the legs 62 of the connecting member 60 on the cap 17.

The base member 15 can also include, for example, a wall member 30 that extends from an end portion of the base member 15 and surrounds the ribs 20. The wall member 30 has an inner surface 32 and an outer surface 34. The inner surface 32 of the wall member 30 defines a cavity 38 within the base member 15 that includes an opening between the wall member 30 and the ribs 20. As shown in the Figures, the cavity 38, the channels 24, and the grooves 26 are all open spaces defined within the wall member 30 of the base member 15. Embodiments of the base member can be, for example, translucent solvent resistant hydrophobic resilient polymeric material.

Referring again to FIGS. 1-6, embodiments of the insulating cap 17 can include, for example, an end wall 42 and a pair of peripheral side walls 44, 50. The side walls can include an inside wall 44 having an inner surface 46 and an outer surface 48 and an outside wall 50 having an inner surface 52 and an outer surface 54. The outer surface 48 of the inside wall 44 of the cap 17 can interface with the inner surface 32 of the wall member 30 of the base member 15 when the cap 17 is fit onto the base member 15. The inner surface 52 of the outside wall 50 of the cap 17 can interface with the outer surface 34 of the wall member 30 when the cap 17 is fit onto the base member 15. In this manner, as a result of fitting the cap 17 onto the base member 15, the inside wall 44 of the cap 17 can penetrate a portion of the cavity 38 of the base member 15, and the outside wall 50 of the cap 17 can surround a portion of the wall member 30 of the base member 15 when the wall member 30 is interposed between the side walls 44, 50 of the cap 17, responsive to sufficient force applied against the end wall 42 of the cap 17 to force the cap 17 and the base member 15 toward each other.

Embodiments of the invention can include, for example, a straight linear metallic conductive connecting member 60 or alternatively a generally U-shaped metallic conductive connecting member 61 that can be affixed to the cap 17, and which affords good electrical contact with the wires when properly installed. The connecting member 60 can be supported by the cap 17 at an interior surface of the end wall 42 of the cap 17 and housed within the side walls 44, 50 of the cap 17. The connecting member 60 can be a plate having at least one deep cutting-and-connecting slot 64 extending between several legs 62. The cutting-and-connecting slot 64 of the connecting member 60 is positioned on the cap 17 in an aligned relationship with the wire-supporting channel 24 of the base member 15. The slots 64 should be smaller in thickness than the diameter of the insulated cable to be cut by the slots 64 and slightly smaller than the diameter of the conductor to be deformed and connected. The slots 64 in the connecting member 60 are designed to fit within the grooves 26 in the base member 15 and to align with each of the wire-receiving channels 24 of the ribs 20, whereby the connecting member 60 affords effective conductive contact with the wires disposed in the channels 24 of the ribs 20 when the cap 17 and the base member 15 are fit onto each other. The connecting member 60 can be formed of electrically conductive ductile metal, about 0.036 inch (0.9144 mm) thick, such as a copper alloy, e.g. 260 cartridge brass. The hardness of the connecting member 60 can be ¾ hardness or H03.

Figure 1:
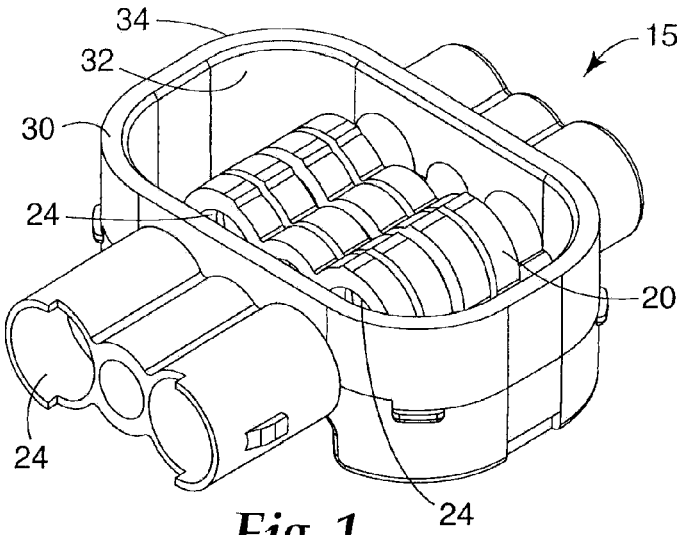
FIG. 1 is an isometric view of a base member according to an embodiment of the invention.
Figure 2:
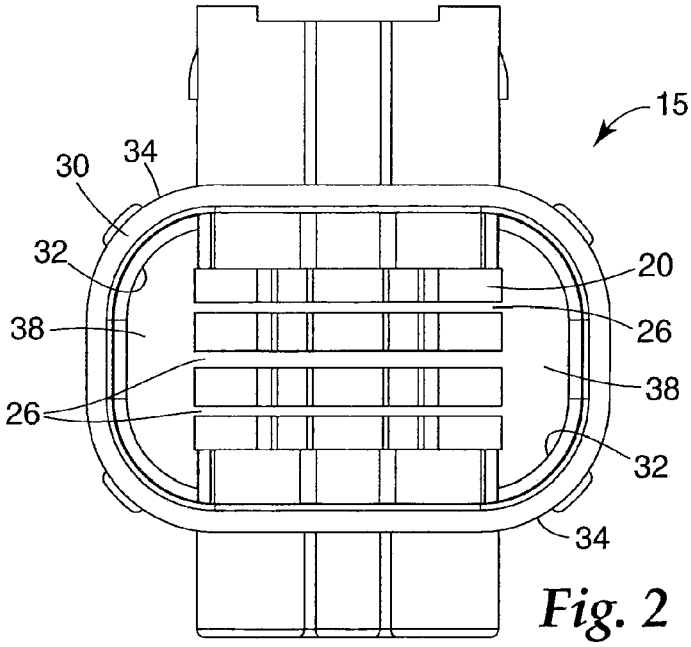
FIG. 2 is a top view of the base member of FIG. 1.
Figure 3:
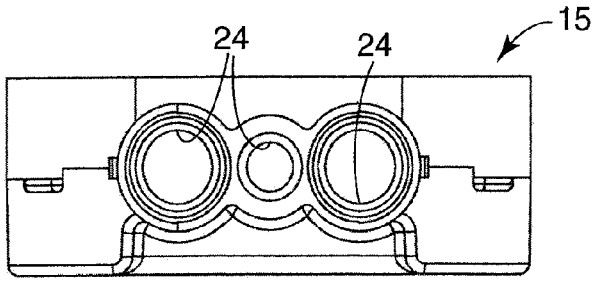
FIG. 3 is a side view of the base member of FIG. 1.
Figure 4:
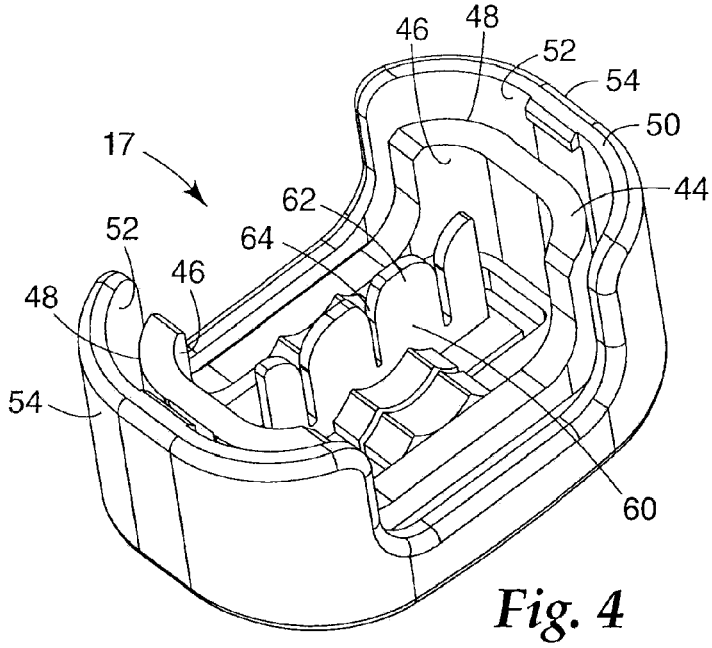
FIG. 4 is an isometric view of a cap according to an embodiment of the invention.
Figure 5:
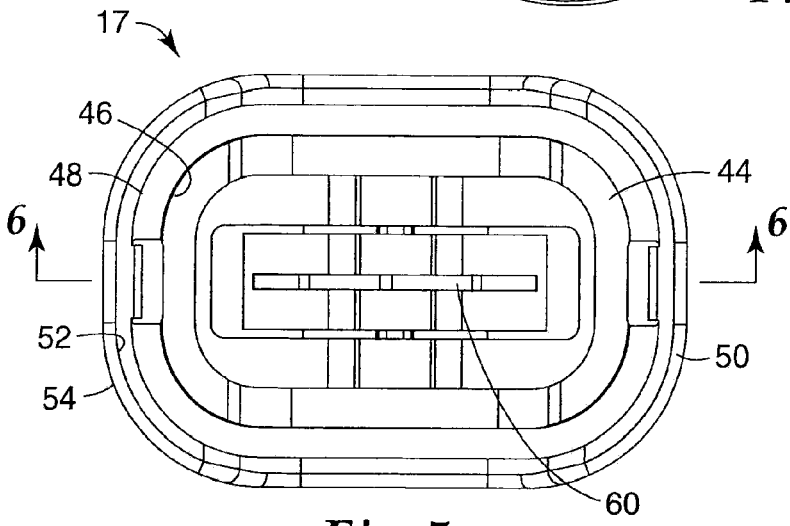
FIG. 5 is a top view of the cap of FIG. 4.
Figure 6:
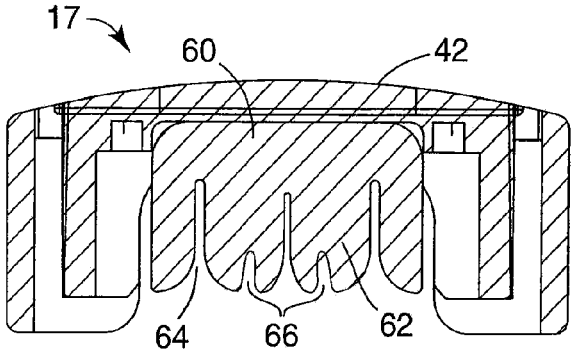
FIG. 6 is a cross-sectional side view of the cap of FIG. 5.
Figure 7:
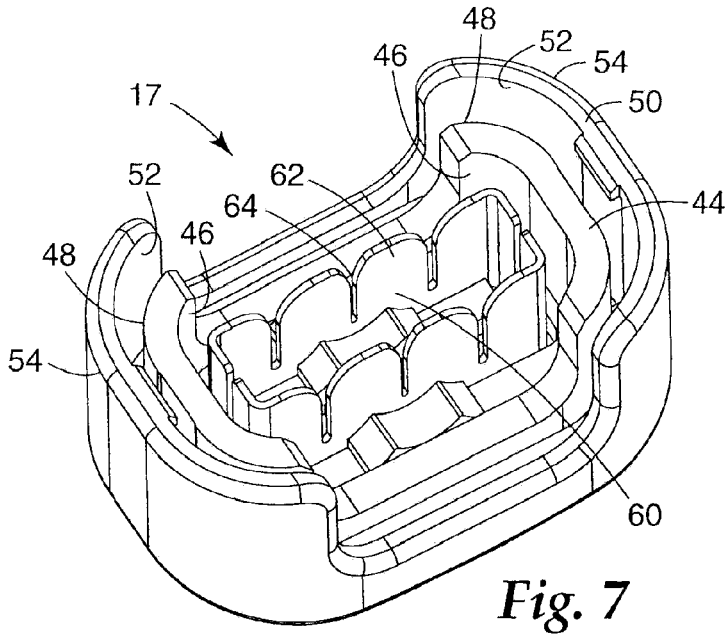
FIG. 7 is an isometric view of an alternative cap according to an embodiment of the invention.
Figure 8:
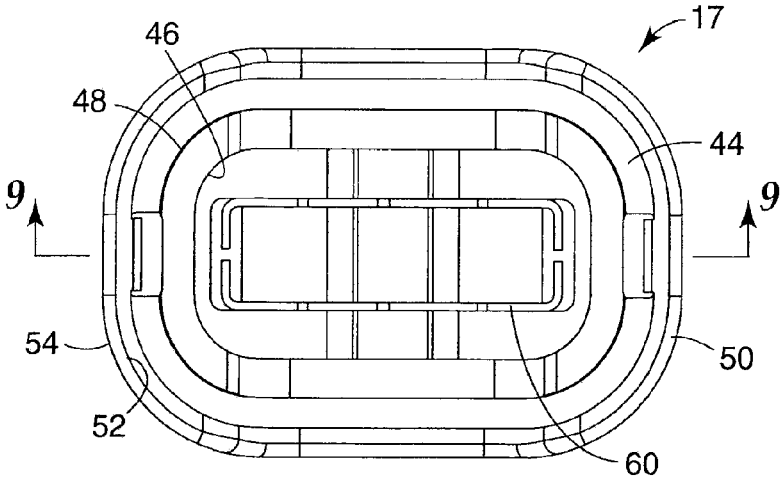
FIG. 8 is a top view of the cap of FIG. 8.
Figure 9:
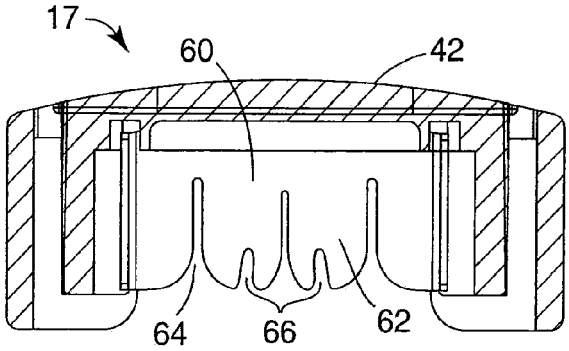
FIG. 9 is a cross-sectional side view of the cap of FIG. 7.

Exemplary embodiments of the connecting member 60 show that the connecting member 60 can be formed in a single row (as in FIGS. 4-6) or the connecting member 61 can be formed alternatively in a double row (as in FIGS. 7-9). The single row connecting member 60 (FIGS. 4-6) would require a single groove 26 between the ribs 20 of the base member 15, and the double row connecting member 61 (FIGS. 7-9) would require multiple grooves 26 between the ribs 20 of the base member 15.

In some embodiments, for example, disposed between the cutting-and-connecting slots 64 is a clearance slot 66 which affords greater flexibility for the legs 62 of the connecting member 60. Therefore, even with the material being stressed beyond the yield point there is a continuous resilient force on the wire to maintain good electrical contact due to the elastic deformation of the material forming the connecting member 60. The characteristics and properties of such clearance slots 66 are generally understood by those skilled in the art.

The geometry of the connecting member 60 allows the plastic deformation without fracturing the connecting member 60. This is accomplished by the presence of the clearance slot 66 disposed between the slots 64. Since the parallel walls of the slots 64 are forced apart as a conductor enters the flared entrance thereto the wire pushes the narrow band of material on one side of the slot 64 toward the center of the plate which forces the clearance slot 66 to close at the entrance and forces the material on the other side of the slot 64 toward the end of the plate 60. There is approximately equal movement on each side of the wire. Further, the tendency of the connecting member 60 to fracture when undergoing any plastic deformation is reduced by placing a radius at the bottom of the slot 64 which is somewhat larger than 1.5 times the width of the slot to afford reduced stress concentration without loss of effectiveness in making good electrical contact.

The deflection of the material of the connecting member 60 from the slots 64 toward the ends of the connecting member 60 may, in some embodiments, serve to urge the legs 62 of the connecting member 60 firmly against the inner surface of the wall member 30 of the base member 15 when in wire connecting position. Therefore, as the cap 17 is inserted into the base member 15, the making of the junction with the conductor 16 of the wires also in some embodiments can improve the mechanical fastening of the cap 17 to the base 15.

In some embodiments, a conformable sealant can be used as an effective encapsulant of the wire connections to restrict the subsequent entry of water. The conformable sealant can preferably fill the entire volume including all interstices of the connector unit 10 when the connector unit 10 is in a closed connecting position, which includes filling the tubular wire receiving passages 24 when a wire connection is made. The conformable sealant can include, for example, conformable greases, conformable gels, soft plastic materials, polyisobutylene, polybutene synthetic rubber, mineral oil, amorphous silica, antioxidants, silicone greases, greases having an oil extended Krayton base, and any other suitable conformable material.

The base member 15 and cap 17 can be molded of a flexible polymeric material which is preferably translucent and solvent resistant. This material is generally resilient, i.e., having good tensile strength and sufficient modulus of elasticity to afford 10 to 20% elongation. An exemplary material with these properties is a polyolefin, for example polypropylene, which is less expensive than polycarbonate. Alternatively, a nylon material can be used to construct the base member 15 and cap 17.

Figure 10:
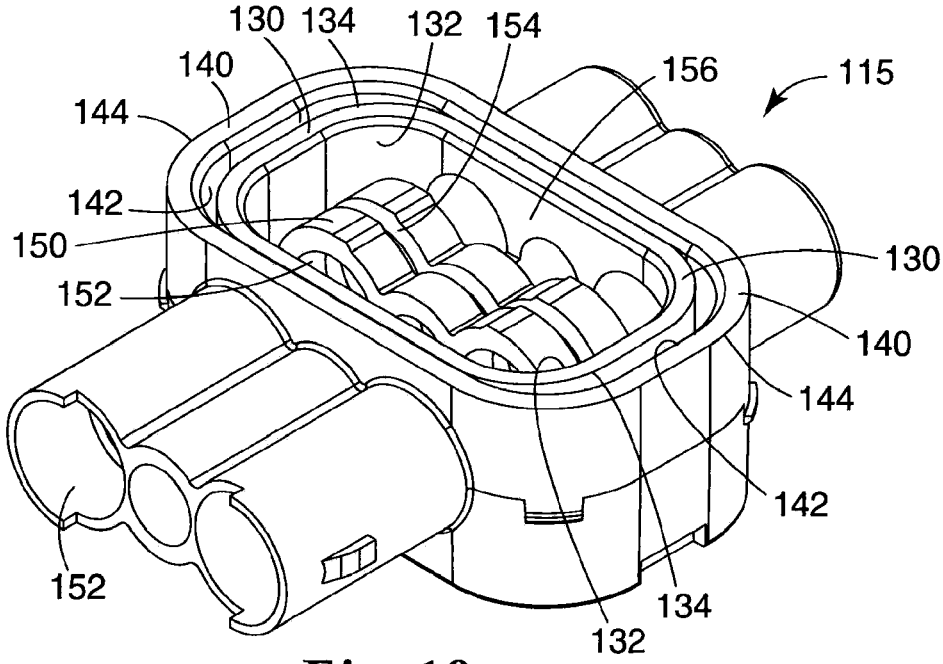
FIG. 10 is an isometric view of a base member according to an alternative embodiment of the invention.
Figure 11:
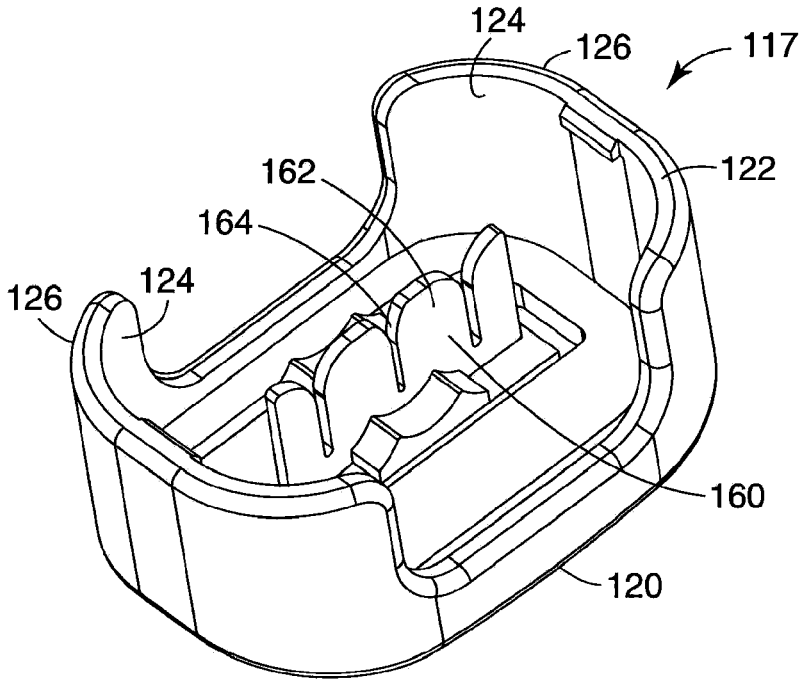
FIG. 11 is an isometric view of a cap according to an alternative embodiment of the invention.

Embodiments of the invention can also include, for example, a connector including a single-wall cap 117 fit onto a double-wall base member 115. This alternative illustrative embodiment of the base member 115 and cap 117 is shown in FIGS. 10-11. Embodiments of the cap 117 can include, for example, an end wall 120 and a side wall 122 having an inner surface 124 and an outer surface 126.

Embodiments of the base member 115 can include, for example, a pair of wall members 130, 140 including an inside wall member 130 and an outside wall member 140. The inside wall member 130 can have an inner surface 132 and an outer surface 134 and the outside wall member 140 can have an inner surface 142 and an outer surface 144. The outer surface 134 of the inside wall member 130 of the base member 115 can interface with the inner surface 124 of the side wall 122 of the cap 117 when the cap 117 is fit onto the base member 115. The inner surface 142 of the outside wall member 140 of the base member 115 can interface with the outer surface 126 of the side wall 122 of the cap 117 when the cap 117 fits onto the base member 115. In this manner, as a result of fitting the cap 117 onto the base member 115, the inside wall member 130 of the base member 115 can penetrate an interior portion of the cap 117 and the outside wall member 140 of the base member 115 can surround a portion of the side wall 122 of the cap 117 when the side wall 122 of the cap 117 is interposed between the wall members 130, 140 of the base member 115, responsive to sufficient force applied against the end wall 120 of the cap 117 to force the cap 117 and the base member 115 toward each other.

Embodiments of the base member 115 can include, for example, a number of side-by-side elongate ribs 150 forming wire-receiving channels 152 to support or carry a number of corresponding wires or wire-ends to be connected. The ribs 150 can begin at an end of a throat portion of the base member 115 and extend into a body portion where they provide wire supporting channels 152. The wire-receiving channels 152 formed by the ribs 150 can be tubular, cylindrical, or circular spaces to allow a tubular wire to be extended and supported therethrough. The wire-receiving channels 152 can have an inner diameter that substantially interfaces with a portion of the outer diameter of a wire to be connected in the connector. The number of ribs 150 can be spaced apart such that at least one groove 154 extends between each of the ribs and generally perpendicular to the channels 152 to receive the legs 162 of the connecting member 160 on the cap 117. The inside wall member 130 of the base member 115 can surround the ribs 150 thereby defining a cavity 156 within the base member including an opening between the ribs 150 and the inside wall member 130.

Referring again to FIGS. 10-11, embodiments of the invention can include, for example, a metallic conductive connecting member 160 or contact element 160 that can be affixed to the cap 117, and which affords good electrical contact with the wires when properly installed. The connecting member 160 can be supported by the cap 117 at an interior surface of the end wall 120 of the cap 117 and housed within the side wall 122 of the cap 117. The connecting member 160 can be a plate having at least one deep cutting-and-connecting slot 164 extending between several legs 162. The cutting-and-connecting slot 164 of the connecting member 160 is positioned on the cap 117 in an aligned relationship with the wire-supporting channel 152 of the base member 115. The slots 164 should be smaller in thickness than the diameter of the insulated cable to be cut by the slots 164, and the slots 164 should be slightly smaller than the diameter of the conductor to be connected. The slots 164 in the connecting member 160 are designed to fit within the grooves 154 in the base member 115 and to align with each of the wire-receiving channels 152 of the ribs 150, whereby the connecting member 160 affords effective conductive contact with the wires disposed in the channels 152 of the ribs 150 when the cap 117 and the base member 115 are fit onto each other.

Figure 12:
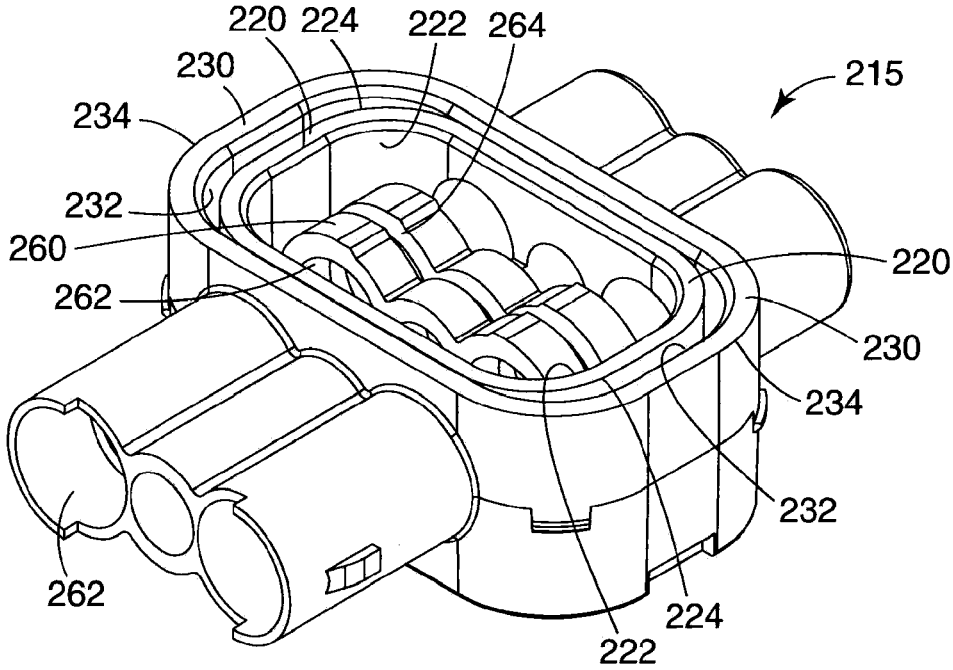
FIG. 12 is an isometric view of a base member according to an alternative embodiment of the invention.
Figure 13:
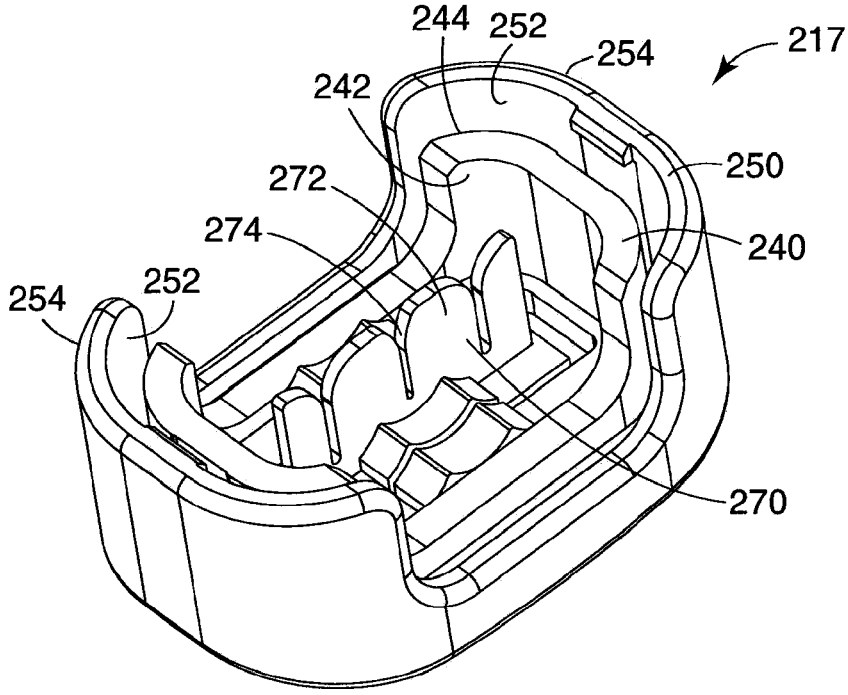
FIG. 13 is an isometric view of a cap according to an alternative embodiment of the invention.
Figure 14:
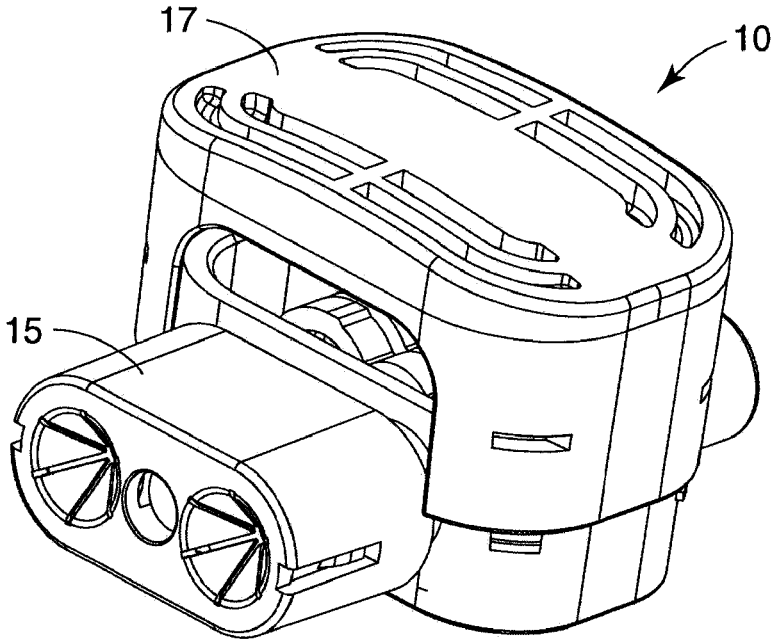
FIG. 14 is an isometric view of the base member and cap collectively as an open non-connecting unit.

Embodiments of the invention can also include, for example, a connector including a double-wall cap 217 fit onto a double-wall 215 base member. This alternative illustrative embodiment of the base member 215 and cap 217 is shown in FIGS. 12-13.

Embodiments of the base member 215 can include a pair of wall members 220, 230 including an inside wall 220 and an outside wall 230. The inside wall 220 of the base member 215 can have an inner surface 222 and an outer surface 224 and the outside wall 230 of the base member 215 can have an inner surface 232 and an outer surface 234. Embodiments of the cap 217 can include a pair of side walls 240, 250 including an inside wall 240 and an outside wall 250. The inside wall 240 of the cap 217 can have an inner surface 242 and an outer surface 244 and the outside wall 250 of the cap 217 can have an inner surface 252 and an outer surface 254.

Embodiments of the invention can include, for example, a number of side-by-side elongate ribs 260 extending from the base member 215 which can be housed within the inside wall 220 of the base member 215. The ribs 260 can form wire-receiving channels 262 that support the plurality of wires. At least one groove 264 can extend between each of the ribs 260 and generally perpendicular to the channels 262.

Embodiments of the invention can include, for example, a metallic conductive connecting member 270 or contact element 270 that can be affixed to the cap 217, and which affords good electrical contact with the wires when properly installed. The connecting member 270 can be supported by the cap 217 at an interior surface of the end wall of the cap 217 and housed within the inside side wall 240 of the cap 217. The connecting member 270 can be a plate having at least one deep cutting-and-connecting slot 274 extending between several legs 272. The cutting-and-connecting slot 274 of the connecting member 270 is positioned on the cap 217 in an aligned relationship with the wire-supporting channel 262 of the base member 215. The slots 274 should be smaller in thickness than the diameter of the insulated cable to be cut by the slots 274. The slots 274 in the connecting member 270 are designed to fit within the grooves 264 in the base member 215 and to align with each of the wire-receiving channels 262 of the ribs 260, whereby the connecting member 270 affords effective conductive contact with the wires disposed in the channels 262 of the ribs 260 when the cap 217 and the base member 215 are fit onto each other.

In one embodiment, for example, the inner surface 242 of the inside wall 240 of the cap 217 interfaces with the outer surface 224 of the inside wall 220 of the base member 215, the outer surface 244 of the inside wall 240 of the cap 217 interfaces with the inner surface 232 of the outside wall 230 of the base member 215, and the inner surface 252 of the outside wall 250 of the cap 217 interfaces with the outer surface 234 of the outside wall 230 of the base member 215, responsive to sufficient force applied to move the cap 217 and the base member 215 into engagement with each other.

In another embodiment, for example, the inner surface 222 of the inside wall 220 of the base member 215 interfaces with the outer surface 244 of the inside wall 240 of the cap 217, the outer surface 224 of the inside wall 220 of the base member 215 interfaces with the inner surface 252 of the outside wall 250 of the cap 217, and the inner surface 232 of the outside wall 230 of the base member 215 interfaces with the outer surface 254 of the outside wall 250 of the cap 217, responsive to sufficient force applied to move the cap 217 and the base member 215 into engagement with each other.

Various embodiments of the connector include advantages which include but are not limited to the following. For example, embodiments of the invention can enhance the relative strength, stability, and durability of the connector unit as a whole. In this manner, for example, the connecting member can be less likely to wobble during installation and can be more likely to remain stable upon application of the forces necessary to cut through cable insulation and make an effective connection. As a result, a unidirectional stabilizing effect can be realized that over time increases the durability of the connector unit as a whole. Under application of increasing force, the base member and cap can remain relatively strong and stable until the proper connection is made and the base member and cap join together to produce a single closed connector unit.

In some embodiments, the connector, when in a closed connecting position including the base member and cap being fit onto each other, can advantageously exhibit characteristics that pass all aspects of the test defined by UL486D-Sequence D. In some embodiments, the connector, when in a closed connecting position including the base member and cap being fit onto each other, can advantageously exhibit characteristics that pass all aspects of the test defined by UL486D-Sequence E. Other embodiments may alternatively exhibit characteristics that pass alternative tests in various industries, including but not limited to tests including UL486C, UL486D (Sequences A-C), other various UL and CSA tests, among others in many different industries. Embodiments of this invention can be utilized within the automotive industry, the RV industry, the irrigation industry, the electrical industry, the telecommunications industry, and any other suitable industry that utilizes connectors.

Although the aforementioned detailed description contains many specific details for purposes of illustration, anyone of ordinary skill in the art will appreciate that many variations, changes, substitutions, and alterations to the details are within the scope of the invention as claimed. Accordingly, the invention described in the detailed description is set forth without imposing any limitations on the claimed invention. For example, any reference to terms such as mounted, connected, attached, joined, coupled, etc. should be construed broadly so as to include such mounting, connecting, attaching, joining, coupling, etc. as having been achieved indirectly, directly, and/or integrally. The proper scope of the invention should be determined by the following claims and their appropriate legal equivalents.

The invention claimed is:

1. A wire connector for connecting a plurality of wires comprising:

a base member having a plurality of side-by-side elongate ribs forming wire-receiving channels adapted to support the plurality of wires, at least one groove extending between each of the ribs and generally perpendicular to the channels, the base member having a wall member having an inner and outer surface housing the ribs and defining a cavity within the base member including an opening between the wall member and the ribs;

a cap adapted to fit onto the base member, the cap having an end wall and a pair of side walls comprising inside and outside walls both having inner and outer surfaces, the outer surface of the inside wall of the cap configured to interface with the inner surface of the wall member of the base member and the inner surface of the outside wall of the cap configured to interface with the outer surface of the wall member of the base member, such that the inside wall of the cap penetrates a portion of the cavity of the base member and the outside wall of the cap surrounds a portion of the wall member of the base member when the wall member of the base member is interposed between the side walls of the cap responsive to sufficient force applied to move the cap and the base member into engagement with each other; and a conductive connecting member comprising a plate affixed to the cap and adapted to fit within the groove in the base member, the connecting member supported by the cap at an interior surface of the end wall of the cap and housed within the side walls, the plate having at least one slot, each slot configured to be aligned with each of the channels of the ribs, whereby the connecting member is adapted to afford effective conductive contact with the plurality of wires disposed in the channels of the ribs.

2. The connector as defined by claim 1, further comprising an outside strength member extending from the base member outside of the wall member and substantially parallel to the wall member, the strength member adapted to hang over and retain at least a portion of the outside wall of the cap.

3. The connector as defined by claim 1, wherein the thickness of the wall member of the base member is substantially similar to the distance between the outer surface of the inside wall of the cap and the inner surface of the outside wall of the cap.

4. The connector as defined by claim 1, wherein the connector, when in a closed connecting position including the base member and cap being fit onto each other, exhibits characteristics that pass all aspects of the test defined by UL486D-Sequence D.

5. The connector as defined by claim 1, wherein the connector, when in a closed connecting position including the base member and cap being fit onto each other, exhibits characteristics that pass all aspects of the test defined by UL486D-Sequence E.

6. The connector as defined by claim 1, wherein the base member is formed of a translucent solvent resistant hydrophobic resilient polymeric material.

7. The connector as defined by claim 1, wherein the connecting member is a U-shaped member comprising at least a pair of plates.

8. The connector as defined by claim 1, further comprising a conformable sealant adapted to fill an entire volume of the connector including all interstices of the connector when the connector is in a closed connecting position.

9. A wire connector for connecting a plurality of wires comprising:

a cap having an end wall and a side wall having an inner and an outer surface;

a base member adapted to fit onto the cap, the base member having a pair of wall members comprising inside and outside wall members both having inner and outer surfaces, the outer surface of the inside wall member of the base member configured to interface with the inner surface of the side wall of the cap and the inner surface of the outside wall member of the base member configured to interface with the outer surface of the side wall of the cap, such that the inside wall member of the base member penetrates an interior portion of the cap and the outside wall member of the base member surrounds a portion of the side wall of the cap when the side wall of the cap is interposed between the wall members of the base member responsive to sufficient force applied to move the cap and the base member into engagement with each other;

a plurality of side-by-side elongate ribs extending from the base member and housed within the inside wall member, the ribs forming wire-receiving channels adapted to support the plurality of wires, at least one groove extending between each of the ribs and generally perpendicular to the channels; and a conductive connecting member comprising a plate affixed to the cap and adapted to fit within the groove in the base member, the connecting member supported by the cap at an interior surface of the end wall of the cap and housed within the side wall, the plate having at least one slot, each slot configured to be aligned with each of the channels of the ribs, whereby the connecting member is adapted to afford effective conductive contact with the plurality of wires disposed in the channels of the ribs.

10. The connector as defined by claim 9, further comprising an outside strength member extending from the cap outside of the side wall and substantially parallel to the side wall, the strength member adapted to hang over and retain at least a portion of the outside wall member of the base member.

11. The connector as defined by claim 9, wherein the thickness of the wall member of the base member is substantially similar to the distance between the outer surface of the inside wall of the cap and the inner surface of the outside wall of the cap.

12. The connector as defined by claim 9, wherein the connector, when in a closed connecting position including the base member and cap being fit onto each other, exhibits characteristics that pass all aspects of the test defined by UL486D-Sequence D.

13. The connector as defined by claim 9, wherein the connector, when in a closed connecting position including the base member and cap being fit onto each other, exhibits characteristics that pass all aspects of the test defined by UL486D-Sequence E.

14. The connector as defined by claim 9, wherein the base member is formed of a translucent solvent resistant hydrophobic resilient polymeric material.

15. The connector as defined by claim 9, wherein the connecting member is a U-shaped member comprising at least a pair of plates.

16. The connector as defined by claim 9, further comprising a conformable sealant adapted to fill an entire volume of the connector including all interstices of the connector when the connector is in a closed connecting position.

17. A wire connector for connecting a plurality of wires comprising:

a base member having a pair of wall members comprising inside and outside walls both having inner and outer surfaces;

a cap having an end wall and a pair of side walls comprising inside and outside walls both having inner and outer surfaces;

the inner surface of the inside wall of the cap configured to interface with the outer surface of the inside wall of the base member, the outer surface of the inside wall of the cap configured to interface with the inner surface of the outside wall of the base member, and the inner surface of the outside wall of the cap configured to interface with the outer surface of the outside wall of the base member, responsive to sufficient force applied to move the cap and the base member into engagement with each other;

a plurality of side-by-side elongate ribs extending from the base member and housed within the inside wall of the base member, the ribs forming wire-receiving channels adapted to support the plurality of wires, at least one groove extending between each of the ribs and generally perpendicular to the channels; and a conductive connecting member comprising a plate affixed to the cap and adapted to fit within the groove in the base member, the connecting member supported by the cap at an interior surface of the end wall of the cap and housed within the side walls, the plate having at least one slot, each slot configured to be aligned with each of the channels of the ribs, whereby the connecting member is adapted to afford effective conductive contact with the plurality of wires disposed in the channels of the ribs.

18. A wire connector for connecting a plurality of wires comprising:

a base member having a pair of wall members comprising inside and outside walls both having inner and outer surfaces;

a cap having an end wall and a pair of side walls comprising inside and outside walls both having inner and outer surfaces;

the inner surface of the inside wall of the base member configured to interface with the outer surface of the inside wall of the cap, the outer surface of the inside wall of the base member configured to interface with the inner surface of the outside wall of the cap, and the inner surface of the outside wall of the base member configured to interface with the outer surface of the outside wall of the cap, responsive to sufficient force applied to move the cap and the base member into engagement with each other;

a plurality of side-by-side elongate ribs extending from the base member and housed within the inside wall of the base member, the ribs forming wire-receiving channels adapted to support the plurality of wires, at least one groove extending between each of the ribs and generally perpendicular to the channels; and a conductive connecting member comprising a plate affixed to the cap and adapted to fit within the groove in the base member, the connecting member supported by the cap at an interior surface of the end wall of the cap and housed within the side walls, the plate having at least one slot, each slot configured to be aligned with each of the channels of the ribs, whereby the connecting member is adapted to afford effective conductive contact with the plurality of wires disposed in the channels of the ribs.

* * * * *